United States Patent [19]

Mayama et al.

[11] 4,198,589

[45] Apr. 15, 1980

[54] SPECTRAL SOURCE, PARTICULARLY FOR ATOMIC ABSORPTION SPECTROMETRY

[75] Inventors: Shinji Mayama, Katsuta; Masataka Koga, Katsuta; Yoji Arai, Katsuta; Konosuke Oishi, Mito, all of Japan

[73] Assignee: Hitachi, Ltd., Japan

[21] Appl. No.: 871,807

[22] Filed: Jan. 24, 1978

[30] Foreign Application Priority Data

Jan. 24, 1977 [JP] Japan ..... 52-5851
Apr. 14, 1977 [JP] Japan ..... 52-43206

[51] Int. Cl.[2] ..... H05B 41/24

[52] U.S. Cl. ..... 315/267; 315/246; 315/344; 356/314; 356/316

[58] Field of Search ..... 315/209 R, 219, 246, 315/267, 344; 313/161; 356/85, 86, 314, 316

[56] References Cited

U.S. PATENT DOCUMENTS

| | | | |
|---|---|---|---|
| 3,623,136 | 11/1971 | Tomita et al. | 356/85 X |
| 3,653,766 | 4/1972 | Walters et al. | 356/86 |
| 3,893,768 | 7/1975 | Stephens | 313/161 X |
| 4,095,142 | 6/1978 | Murayama et al. | 356/85 X |
| 4,097,781 | 6/1978 | Koizumi et al. | 315/344 X |

*Primary Examiner*—Eugene R. LaRoche
*Attorney, Agent, or Firm*—Craig and Antonelli

[57] ABSTRACT

A spectral source comprises a lamp containing an anode and a cathode in an inert gas. The anode and cathode are different in shape and connected to a high-frequency power source to produce a high-frequency discharge between the anode and cathode to cause both sputtering of the cathode and excitation of a radiation having the spectrum according to the material sputtered from the cathode. The application of solely high-frequency power prevents adherence of the sputtered material to the interior walls of the lamp bulb thereby allowing a reduction of the dimensions of the lamp bulb, prolongating the life time of the lamp and increasing the stability and intensity of the radiation. A magnetic field may be applied to the radiation for Zeeman modulation. Due to the relatively small dimensions of the lamp bulb, relatively small and inexpensive magnets may be used.

17 Claims, 8 Drawing Figures

SPECTRAL SOURCE, PARTICULARLY FOR ATOMIC ABSORPTION SPECTROMETRY

BACKGROUND AND SUMMARY OF THE INVENTION

This invention relates to a spectral source and particularly to a spectral source for atomic absorption spectrometry.

In "Spectrochimica Acta" Vol. 28B, pages 51 to 63, a spectral source is disclosed which comprises a hollow cathode lamp including a hollow cathode and a rod-shaped anode, and a microwave power source disposed outside the hollow cathode lamp. D.c. current flowing between the anode and the cathode causes sputtering of the cathode, thereby producing atomic vapors. The atomic vapors are excited by the microwave power so as to emit light of a desired spectrum.

One essential disadvantage of this arrangement resides in the fact that due to the application of microwave power to the atomic vapors, atoms of some of the metals of which the hollow cathode consists will adhere to the interior wall of the lamp bulb, thereby considerably decreasing the lamp life time and the radiation intensity. Increasing the microwave power and thereby the radiation intensity will also increase noise and drift rates, thereby again shortening the life time of the lamp.

The specification of U.S. Pat. No. 3,893,768 to Stephens discloses a Zeeman modulated spectral source which comprises a lamp having an anode and a cathode formed by parallel flat plates of identical shape disposed opposite to each other, and means for applying a magnetic field to the space formed between the anode and the cathode. A d.c. current is caused to flow between the anode and the cathode to cause both cathode sputtering and excitation of the atomic cloud to produce the emission of light having the desired atomic spectrum, the light being Zeeman modulated by the magnetic field. Stephens indicates that a high-frequency or microwave generator may be used as a potential source instead of the d.c. source.

It is the essential disadvantage of this apparatus that the cathode sputtering cannot be performed sufficiently, even by using a high-frequency generator as the power source, because the ions produced by the discharge are caught in the magnetic field due to the identical flat shape of the opposite electrodes so that insufficient collisions between the ions and the cathode take place. Such insufficient cathode sputtering renders the radiation caused by excitation insufficient so that the intensity of the light emitted by the lamp will be low. By raising the high-frequency power in order to increase the cathode sputtering, the wear of the electrode will be increased thereby reducing the life of the lamp. While it is possible to achieve the cathode sputtering by the discharge the atomic vapors produced by sputtering are diffused due to the flat and uniform shape of the parallel electrodes.

Moreover, by applying the magnetic field to the lamp, the voltage for starting the discharge is raised. When the magnetic field is increased to intensify the light emission, the voltage for starting the discharge is raised even more. Although the cathode sputtering is thereby enhanced in quantity, the rise of the voltage for starting the discharge will increase the ion acceleration for cathode sputtering thereby considerably augmenting the wear of the electrode.

It is therefore an object of this invention to provide a spectral source having a long life time.

Another object of the invention is to provide a spectral source which emits radiation of high intensity.

Another object of the invention is to provide a spectral source in which the dimensions of the lamp can be reduced.

Another object of the invention is to provide a spectral source which can achieve a sufficient cathode sputtering so as to create a strong excitation radiation.

An important feature of the invention is the provision of a spectral source which comprises a lamp having a bulb, a first electrode disposed within the bulb and containing an element emitting a desired spectrum, a second electrode having a shape different from that of the first electrode, a high-frequency source connected between said first and second electrodes for establishing a high-frequency discharge therebetween to cause sputtering of the first electrode and excitation of a radiation with said desired spectrum, a gas contained in the bulb for maintaining said discharge, and a window provided by the bulb for transmitting said radiation.

It has been found that by providing two electrodes having different shapes and by applying high-frequency power to the space between those electrodes, a sufficient cathode sputtering, an intensive excitation radiation and a long life of the lamp may be obtained. Simultaneously, the dimension of the bulb, especially the length of the bulb along the direction of light emission, may be reduced.

The above and further objects, features and advantages of the present invention will become more apparent from the following description when taken in connection with the accompanying drawings which show, for purposes of illustration only, several embodiments in accordance with the present invention.

DETAILED DESCRIPTION OF THE PREFERRED EMBODIMENTS

Figure 1:
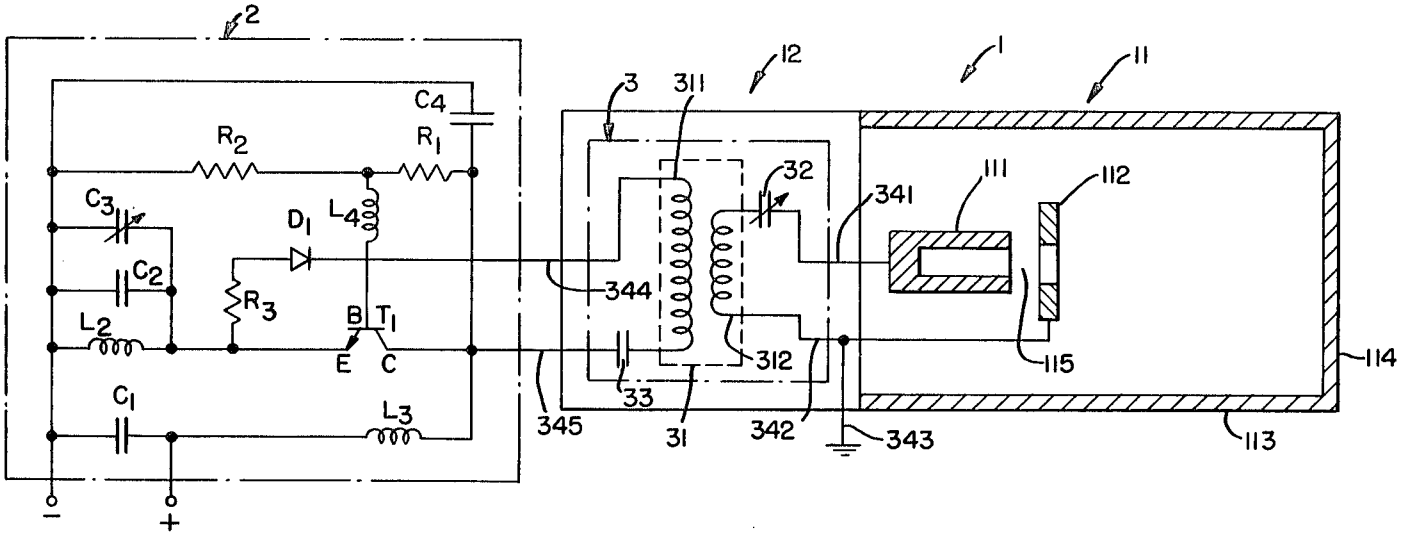
FIG. 1 is a schematic, partly sectional, overall view of a spectral source according to a first preferred embodiment of the invention.

According to the embodiment of the invention shown in FIG. 1, the spectral source includes three portions, namely a lamp 1 for emitting a radiation with the spectrum of certain desired metal elements, a high frequency power section 2 for applying high-frequency power to the lamp 1, and an impedance adapter 3 for adapting the impedance of the high-frequency power section 2 to that of the lamp 1. The three portions are electrically interconnected.

The lamp 1 includes a light emitting portion within which the cathode sputtering and the excitation of the radiation take place, and a socket 12 for introducing the high-frequency power. The light emitting portion 11 includes a first electrode 111 containing the desired metal element and a second electrode 112 having a shape different from the shape of the first electrode 111, and a bulb 113 within which the first and second electrodes 111, 112 and an inert gas are contained. The shapes of the first and second electrodes 111, 112 are not restricted except that they are different from each other. The electrodes are disposed so as to provide a space 115 therebetween. The second electrode 112 is disposed opposite the first electrode 111. Alternatively, the second electrode 112 may be disposed outside the bulb 113 to surround the first electrode 111. One end of the bulb 113 provides a window 114 for transmitting the radiation, while the other end of the bulb is hermetically sealed.

In the present embodiment shown in FIG. 1, the first electrode 111 may preferably be formed as a hollow electrode for obtaining the so-called hollow effect. The second electrode 112 is preferably in the form of a disc having a central hole as shown in FIG. 1.

The impedance adapter 3 includes a transformer 31 having a primary coil 311 and a secondary coil 312, a variable capacitor 32, and a capacitor 33. One side of the secondary coil 312 is connected by the variable capacitor 32 and a line 341 to the first electrode 111 of the lamp 1, while the other side of the secondary coil 312 is connected by a line 342 to the second electrode 112. One side of the primary coil 311 is connected by a line 344 to the high-frequency power section 2, and the other side of the primary coil 311 is connected by the capacitor 33 and a line 345 also to the power section 2. The second electrode 112 may be grounded by a line 343. By reducing the dimension of the impedance adapter 3, the same may be housed in the socket or base 12 of the lamp 1.

The high-frequency power section 2 comprises an electric circuit which may include capacitors C1 to C4, resistors R1 to R3, reactances L1 to L3, a transistor T1, and a diode D1, interconnected as shown in FIG. 1.

The operation of the light source described above is as follows. The high-frequency power produced by the power section 2 is supplied through the impedance adapter 3 to the lamp 1. In the impedance adapter 3, the high-frequency power is transformed by the transformer 31, by which the impedance is changed, transmitted via the variable capacitor 32 which compensates for inducances of the transformer 31 and the lamp 1, and applied between the first and second electrodes 111, 112.

In the light emitting portion 11, the high-frequency power creates a high-frequency discharge between the first and second electrodes to ionize the inert gas contained in the bulb 113. The thus produced ions collide with the first electrode 111 without being caught within the high-frequency field, because the high-frequency power is rectified due to the difference in shape between the first and second electrodes, 111, 112. For this reason, the cathode sputtering takes place sufficiently and completely at low high-frequency power. By the ion bombardment of the first electrode 111, i.e. by the cathode sputtering, atomic vapors of the metal elements contained in the first electrode 111 are created within the space 115 formed between the two electrodes. These atomic vapors are retained within the space 115 for a longer period without diffusing. They are thus excited by the further supplied small high-frequency power, and the radiation having the spectrum of the metal elements is transmitted through the window 114 of the light emitting portion 11. Grounding the second electrode 112 intensifies the emitted radiation.

The following effects are brought about according to the embodiment of FIG. 1. Due to the difference in shape between the first electrode 111 and the second electrode 112, the high-frequency power is rectified thereby causing the ions produced in the high-frequency discharge to collide with the first electrode 111 without being trapped in the high-frequency field, so that cathode sputtering takes place sufficiently and completely at low high-frequency power. The atomic vapors thereby produced are maintained within the space formed by the difference in shape between the first and second electrodes for a longer period of time without being diffused, whereby the radiation is excited sufficiently and completely at the low high-frequency power and a radiation of high intensity is emitted. Because the high-intensity radiation is obtained at low high-frequency power, wear of the first electrode 111 is reduced, thereby extending the life time of the light emitting section 11 and thus of the entire lamp 1.

Since only high-frequency power is employed for the sputtering of the cathode and the excitation of the radiation, the metal elements of the first electrode 111 do not at all adhere to the interior wall of the bulb 113, thereby again increasing the life time of the lamp 1 and at the same time permitting a reduction of both the diameter of the bulb and the distance between the electrodes and the window 114. As a result, the overall dimensions of the lamp 1 are reduced.

When the lamp 1 according to the invention is used in an apparatus for the atomic absorption analysis in which a magnetic field is applied to the lamp for Zeeman modulating the radiation, only a small magnet is required due to the reduction of the dimensions of the bulb 113.

Grounding the second electrode 112 increases the stability of the current flowing between the first and second electrodes 111, 112, thereby enhancing the effectivity of the cathode sputtering and the excitation and intensifying the radiation.

Figure 2:
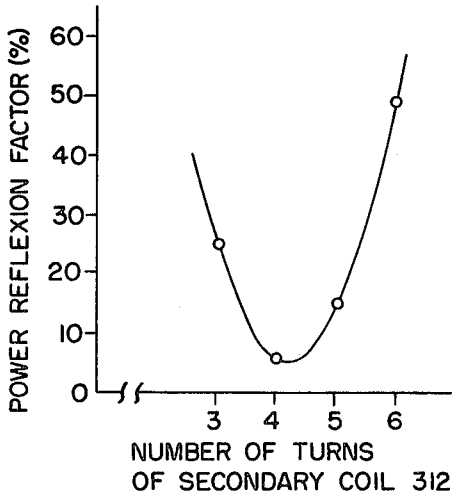

In FIG. 2 in which a characteristic of the impedance adapter 3 of FIG. 1 is shown, the abscissa represents the number of turns of the secondary coil 312 of the transformer 31, while the ordinate represents the power reflection factor. The number of turns of the primary coil 311 is ten. The diagram of FIG. 2 illustrates the power reflection factor in comparison with the input power under the condition that the number of turns of the secondary coil 312 is varied. The capacity of the variable capacitor 32 is set to the most appropriate value obtained by varying the number of turns of the secondary coil 312. In the shown example, the high-frequency power applied amounts to about 10 W and has a frequency of 80 to 100 MHz.

Figure 3:
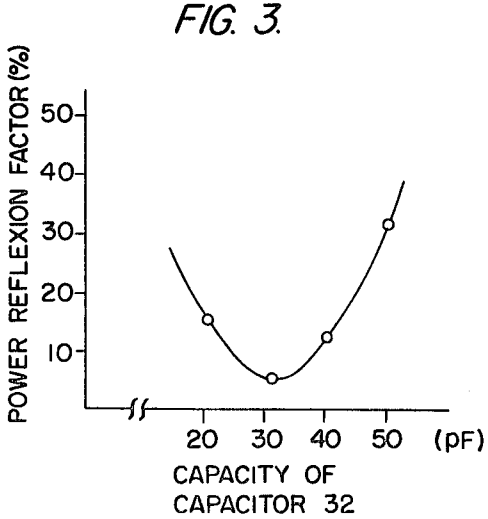
FIGS. 2 and 3 are graphs illustrating certain characteristics of the spectral source shown in FIG. 1.

In FIG. 3 which shows another characteristic of the impedance adapter 3 of FIG. 1, the abscissa represents the capacity of the variable capacitor 32 in pF, while the ordinate again represents the power reflection factor in percent. In this case, the number of turns of the primary transformer coil 311 is ten and that of the secondary coil is four. The capacity of the variable capacitor 32 is varied under this condition.

As is understood from the graphs of FIGS. 2 and 3, the power reflection factor is easily reduced to a few percent by the use of the impedance adapter 3 shown in FIG. 1 whereby the high-frequency discharge is stabilized. If a transformer 31 and capacitors 32 and 33 of small dimensions are used, the impedance adapter 3 may be housed in the socket 12 so that the impdance adapter may be combined with the lamp 1. As a result, the overall structure is simplified and power dissipation is minimized.

Figure 4:
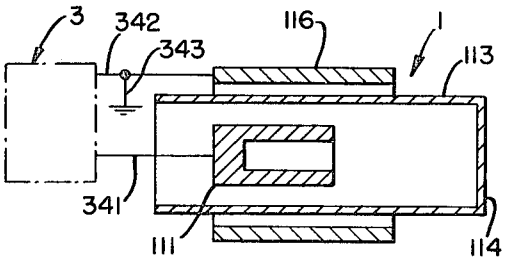
FIG. 4 is a sectional view showing a variation of a portion of the spectral source depicted in FIG. 1 according to a second preferred embodiment of the invention.

FIG. 4 shows another preferred embodiment of the lamp 1. While in the embodiment of FIG. 1, the second electrode 112 is disposed opposite the first electrode 111 within the bulb 113, the second electrode may be disposed outside the bulb 113 on or close to the outer wall thereof, as shown in FIG. 4. In the embodiment of FIG. 4, the second electrode 116 is disposed outside the bulb 113 to surround the first electrode 111, and it is grounded. Under the condition that the second electrode is grounded, it may be formed as an electrode adhering to the bulb 113 like a label. The operation and effect of the electrode arrangement of FIG. 4 is similar to that used in the lamp of FIG. 1.

Figure 5:
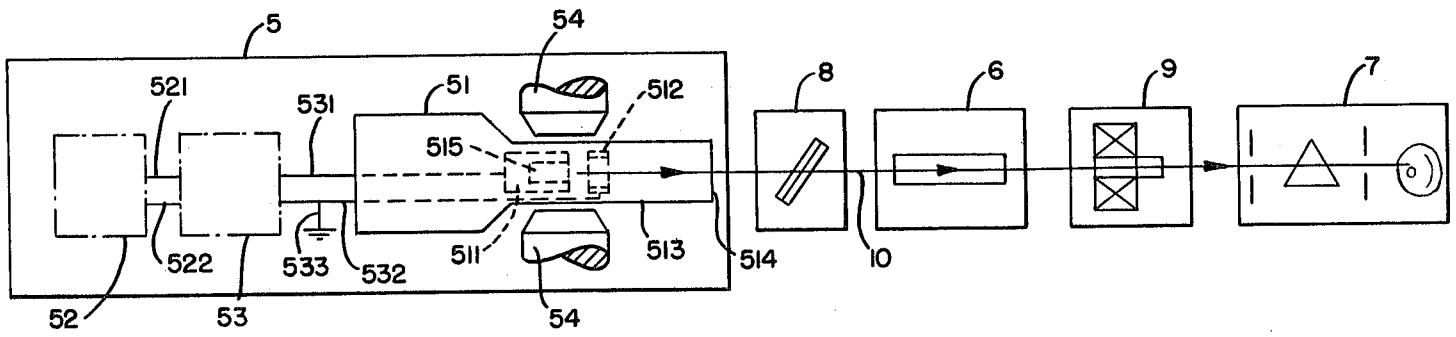
FIG. 5 is a diagrammatic view showing a spectral source according to another embodiment of the invention and applied to an apparatus for the atomic absorption spectrometry.

FIG. 5 shows a preferred embodiment of the invention used as a spectral source for an apparatus for the atomic absorption analysis in which a magnetic field is applied to the lamp for Zeeman modulating the radiation.

The apparatus of FIG. 5 includes a spectral source 5 according to the present invention, an atomizer 6 for atomizing the sample to be analyzed, such as a graphite atomizer or a burner, irradiated by the light from the spectral source 5, and a light detector 7 for detecting the radiation passed through the atomizer 6. A compensator 8 may be disposed between the spectral source 5 and the atomizer 6 for compensating the polarization of the light emitted from the source 5. Furthermore, a polarizer 9 may be placed between the atomizer 6 and the light detector 7 for polarizing the light from the atomizer 6. All portions 5 to 9 of the apparatus are aligned along the same optical path 10.

The spectral source 5 consists of a hollow cathode lamp 51, an impedance adapter 53, a high-frequency power source 52, and a pair of magnets 54 for applying the magnetic field to the lamp 51. The lamp 51 includes a hollow cathode 511 which may consist of such elements as cadmium, copper and aluminum, the hollow portion 515 of which has an inner diameter of about 3 mm and a depth of about 10 mm, a cylindrical anode 512 consisting of nickel and having a diameter of about 8 mm and an axial length of about 3 mm, and a lamp bulb 513 which houses the cathode 511, the anode 512 disposed opposite to the cathode 511 and an inert gas such as argon, helium, neon and the like at a vacuum of about 2 to 10 Torr. The diameter of the bulb 513 is reduced at the location where the magnetic field is applied, and the bulb 513 provides a window 514 at one end and is hermetically sealed at the other end. The cathode 511 and the anode 512 are connected to the impedance adapter 53 by lines 531 and 532, respectively. The anode may be grounded, if desired, by a line 533. The impedance adapter is connected to the high-frequency power source 52 by lines 521 and 522. The impedance adapter 53 and the high-frequency power source are identical to those shown in FIG. 1 so that further description would be redundant. If desired, the impedance adapter 53 may be combined with the hollow cathode lamp 51 as described in connection with FIG. 1.

The operation of the apparatus shown in FIG. 1 is as follows. Applying the high-frequency power to the cathode 511 and anode 512 of the hollow cathode lamp 51 creates a high-frequency discharge between cathode and anode thereby ionizing the inert gas contained in the lamp bulb 513. Since the high-frequency power is rectified due to the difference in shape between the cathode 511 and the anode 512, the ions produced by the high-frequency discharge can invade into the hollow portion 515 of the cathode 511 so that cathode sputtering takes place sufficiently and completely to produce atomic vapors of the desired metallic element. These atomic vapors are further excited by the high-frequency power from the source 52 so that radiation having the desired spectrum of the metal is emitted. Since a magnetic field is applied to the space in which the atomic vapors are retained, the radiation thus produced is Zeeman modulated, and a Zeeman modulated atomic spectrum is emitted from the window 514.

The Zeeman modulated radiation passes through the compensator 8 in which the polarization of the radiation is compensated and then enters the atomizer 6 in which the sample to be analyzed is atomized to produce atomic vapors of the sample. A portion of the radiation penetrating the atomic vapors of the sample is absorbed according to the content of the element to be analyzed. The radiation portion not absorbed by the atomic vapors is furthermore polarized in the polarizer 9 and eventually spectroscopically analyzed and detected in the light detector 7.

Since the high-frequency power is rectified by the difference in shape between the cathode 511 and the anode 512, cathode sputtering and excitation radiation occur sufficiently and completely so that the intensity of the emitted radiation is increased, thereby also increasing the signal-to-noise ratio and enhancing the accuracy of the apparatus for the atomic absorption analysis. Since the metal atoms from the cathode 511 do not adhere to the interior wall of the lamp bulb 513 due to the fact that high-frequency power is used for cathode sputtering and excitation of the radiation, the life of the hollow cathode lamp 51 is extended and the dimensions of the lamp are simultaneously reduced, with the additional advantage that small magnets may be used to apply the magnetic field on the radiation. Furthermore, because of the high-frequency discharge, no care need be taken about the directions of the magnetic and the electric fields so that those fields may be applied in any desired direction. In case a burner is used as the atomizer 6, the accuracy of the apparatus for the atomic absorption analysis operating with a magnetic field applied to the lamp is increased.

Figure 6:
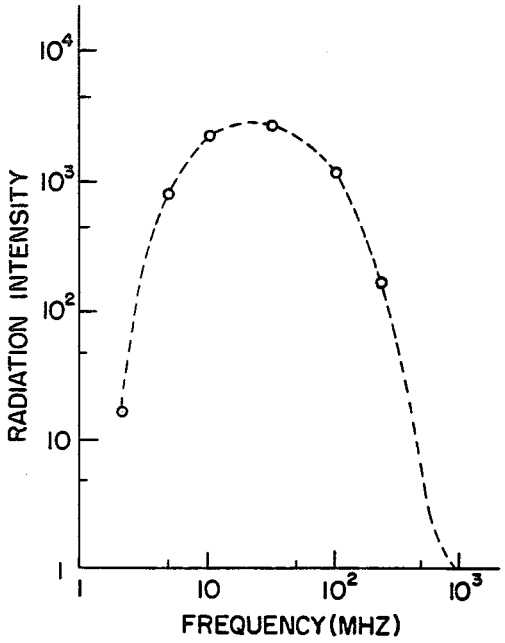
FIGS. 6 to 8 are graphs illustrating certain characteristics of the apparatus shown in FIG. 5.

FIG. 6 illustrates the relationship between the frequency of the high-frequency power depicted on the logarithmic abscissa, and the radiation intensity depicted on the logarithmic ordinate. The distance between the cathode 511 and the anode 512 is for instance 5 mm. The bulb 513 of the hollow cathode lamp 51 is filled with neon as an example of the inert gas at a vacuum of 9 Torr. The magnetic field supplied by the magnets 54 has a strength of 10 kilo-Gauss. A high-frequency power of 15 W is applied between the cathode and the anode. As is clearly shown in FIG. 6, the most appropriate frequency is in the range of 3 MHz to 300 MHz. Below 3 MHz the stability of the high-frequency discharge is lost because the discharge drifts with time, and the location of the discharge is changed. Above 300 MHz, the stability of the high-frequency discharge is also lost and the intensity of the radiation decreases as a result of a deformation of the electrode and of adaptation difficulties. By applying high-frequency power at a frequency of 3 MHz to 300 MHz high stability of the high-frequency discharge and high intensity of the radiation are obtained.

Figure 7:
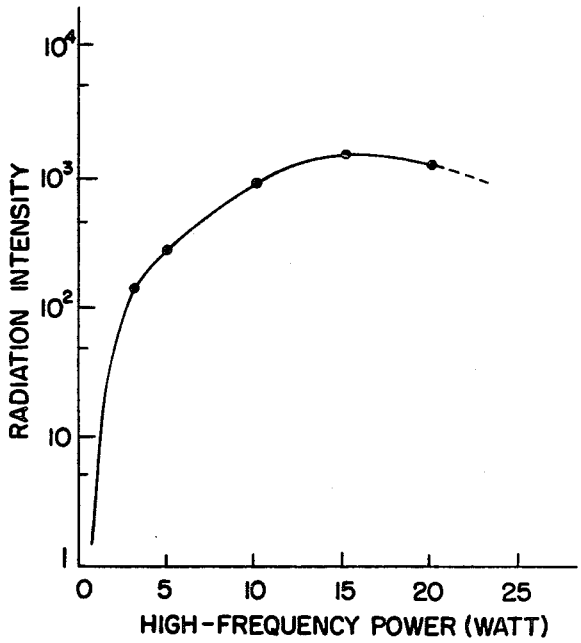

FIG. 7 is a graph illustrating the relation between the amount of high-frequency power shown in Watt along the abscissa, and the radiation intensity shown on the logarithmic ordinate. In this graph, the frequency of the high-frequency power is set to 100 MHz. As is understood from FIG. 7, the most appropriate value of the high-frequency power is in the range of 2 W to 20 W. Below 2 W, only little atomic vapors are produced due to insufficient cathode sputtering so that the intensity of the obtained radiation is very low. At a high-frequency power of for instance 1 W, no cathode sputtering can be performed and, accordingly, no radiation is obtained although the high-frequency discharge occurs. Above 20 W, the electrode is deformed and worn off by heat whereby the life time of the electrode is reduced, and the atomic vapors produced by the cathode sputtering diffuse so that no sufficient radiation can be excited. Applying the high-frequency power at a value of 2 to 20 W, the life time of the lamp and the radiation intensity are increased.

FIGS. 6 and 7 show characteristics of the radiation intensity in response to variations of the frequency and power of the high-frequency power, and in either graph the respective other variable is set to a representative value. When the respective other variable is varied, the respective characteristic will slightly vary accordingly, but its general tendency will not be changed.

Figure 8:
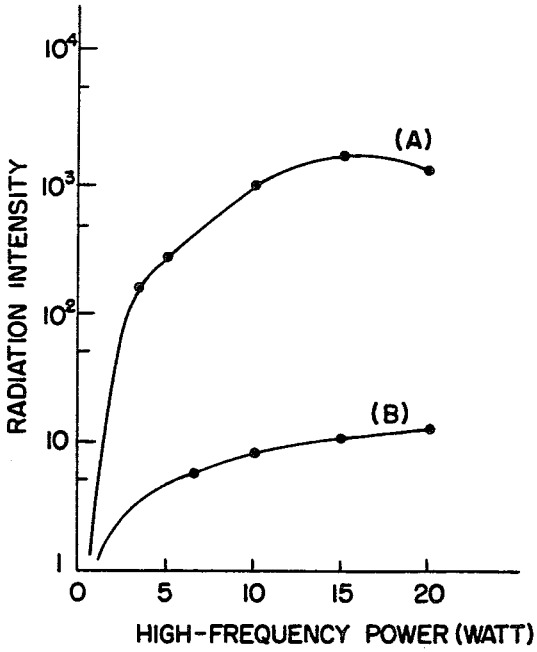

FIG. 8 illustrates the effect brought about by the grounding of the anode 512. In FIG. 8, curve (A) shows the relation between the radiation intensity and the amount of high-frequency power under the condition that the anode 512 is grounded. Curve (B) shows the same relation in the case that the anode 512 is not grounded. As in FIG. 7, the amount of high-frequency power is shown in Watt on the abscissa, while the radiation intensity is depicted along the logarithmic ordinate. As is clearly understood from FIG. 8, the radiation intensity is increased several times by grounding the anode 512.

We claim:

1. A spectral source comprising
- a lamp having a bulb and a base,
- a first electrode having a hollow portion therein, said first electrode being disposed within said bulb and containing an element emitting a desired spectrum,
- a second electrode disposed within said bulb,
- a high-frequency source connected between said first and second electrodes for establishing a high-frequency discharge therebetween to cause sputtering of said first electrode and excitation of a radiation having said desired spectrum,
- a gas contained in said bulb for maintaining said discharge, and
- a window provided by said bulb for transmitting said radiation.

2. The spectral source of claim 1, wherein said first and second electrodes are formed so as to cause rectification of the high-frequency power supplied to said first and second electrodes.

3. The spectral source of claim 1, wherein said bulb has a reduced diameter at the location where said first and second electrodes are disposed.

4. The spectral source of claim 1, wherein said first and second electrode are formed so as to retain the atomic vapor produced by said sputtering between said first and second electrodes.

5. The spectral source of claim 1, wherein said first electrode forms a hollow cathode and said second electrode forms a cylindrical anode.

6. The spectral source of claim 1, comprising means for supplying a magnetic field to the atomic vapor produced by said sputtering.

7. The spectral source of claim 1, wherein said second electrode is grounded.

8. The spectral source of claim 1, comprising means for adapting the impedance of said lamp to that of said high-frequency source.

9. The spectral source of claim 8, wherein said impedance adapting means is contained within said lamp base.

10. The spectral source of claim 1, wherein said second electrode is disposed within said bulb opposite said first electrode.

11. The spectral source of claim 1, wherein said high-frequency source has a frequency between about 3 MHz and about 300 MHz and a power between about 2 W and about 20 W.

12. The spectral source of claim 1, wherein the second electrode is provided with a shape different than the shape of said first electrode.

13. The spectral source of claim 1, wherein the second electrode has a smaller surface area than that of said first electrode.

14. A spectral source comprising
- a lamp having a bulb and a base,
- a hollow cathode disposed within the bulb and containing an element emitting a desired spectrum,
- a cylindrical anode disposed within the bulb opposite said hollow cathode,
- means for applying a high frequency energy between said hollow cathode and said cylindrical anode to cause said hollow cathode to sputter and excite so that a radiation having the desired spectrum is emitted from said hollow cathode through said cylindrical anode,
- a gas contained in the bulb for maintaining the sputtering of said hollow cathode, and
- a window provided by the bulb for transmitting the radiation.

15. The spectral source of claim 14, comprising means for supplying a magnetic field to a space formed between said hollow cathode and said cylindrical anode.

16. The spectral source of claim 15, wherein said means for applying a high-frequency energy has a frequency between about 3 MHz and about 300 MHz and an output power between about 2 W and about 20 W.

17. The spectral source of claim 14, wherein said means for applying a high-frequency energy has a frequency between about 3 MHz and about 300 MHz and an output power between about 2 W and about 20 W.

* * * * *